US007543630B2

(12) United States Patent
Lai et al.

(10) Patent No.: US 7,543,630 B2
(45) **Date of Patent: *Jun. 9, 2009**

(54) HEAT PIPE INCORPORATING OUTER AND INNER PIPES

(75) Inventors: Cheng-Tien Lai, Tu-Chen (TW); Tsung-Lung Lee, Tu-Chen (TW); Shenghua Wang, Shenzhen (CN)

(73) Assignees: Fu Zhun Precision Industry (Shen Zhen) Co., Ltd., Shenzhen City, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 374 days.

This patent is subject to a terminal disclaimer.

(21) Appl. No.: 11/430,504

(22) Filed: May 8, 2006

(65) Prior Publication Data

US 2006/0201656 A1 Sep. 14, 2006

Related U.S. Application Data

(62) Division of application No. 10/144,126, filed on May 10, 2002, now Pat. No. 7,484,553.

(30) Foreign Application Priority Data

Mar. 29, 2002 (TW) ..... 91204055 U

(51) Int. Cl.
*F28D 15/04* (2006.01)

(52) U.S. Cl. ..... 165/104.26; 165/183

(58) Field of Classification Search ..... 165/104.21, 165/104.26, 183

See application file for complete search history.

(56) References Cited

U.S. PATENT DOCUMENTS

| | | | | | |
|---|---|---|---|---|---|
| 3,537,514 | A * | 11/1970 | Levedahl | ..... | 165/104.26 |
| 3,603,382 | A * | 9/1971 | Paine et al. | ..... | 165/104.26 |
| 3,651,240 | A * | 3/1972 | Kirkpatrick | ..... | 219/78.02 |
| 3,769,674 | A * | 11/1973 | Droughton et al. | ..... | 29/890.032 |
| 3,857,441 | A * | 12/1974 | Arcella | ..... | 165/104.26 |
| 3,901,311 | A * | 8/1975 | Kosson et al. | ..... | 165/104.26 |
| 4,109,709 | A * | 8/1978 | Honda et al. | ..... | 165/104.26 |
| 4,116,266 | A * | 9/1978 | Sawata et al. | ..... | 165/104.26 |
| 4,505,326 | A * | 3/1985 | Hazen | ..... | 165/45 |
| 4,765,396 | A * | 8/1988 | Seidenberg | ..... | 165/104.26 |
| 5,046,553 | A * | 9/1991 | Lindner | ..... | 165/104.26 |
| 6,330,907 | B1 * | 12/2001 | Ogushi et al. | ..... | 165/104.26 |
| 6,725,910 | B2 * | 4/2004 | Ishida et al. | ..... | 165/104.26 |

* cited by examiner

*Primary Examiner*—Allen J Flanigan
(74) *Attorney, Agent, or Firm*—Wei Te Chung

(57) ABSTRACT

A heat pipe includes an outer pipe (10), an inner pipe (20), and a hermetic cap (30). The outer pipe has an evaporating end (12) and a condensing end (14). The evaporating end is integrally sealed and receives working fluid. The inner pipe includes an open top and an open bottom. A very narrow gap (40) is defined between the inner pipe and the outer pipe. A plurality of granules is put into the gap to form a porous wicking structure. When the evaporating end is heated by an external heat source, the working fluid is vaporized and flows up along the inner pipe to the condensing end. The working fluid condenses at the condensing end, and flows back down to the evaporating end through the gap. Because the gap is very narrow, surface tension of the working fluid and capillary action of the outer and inner pipes is enhanced.

2 Claims, 5 Drawing Sheets

HEAT PIPE INCORPORATING OUTER AND INNER PIPES

CROSS-REFERENCES TO RELATED APPLICATION

This application is a divisional application of U.S. application Ser. No. 10/144,126, filed on May 10, 2002 now U.S. Pat. No. 7,484,553 and entitled "HEAT PIPE INCORPORATING OUTER AND INNER PIPES".

BACKGROUND OF THE INVENTION

1. Field of the Invention

The present invention relates to a heat pipe for a heat sink assembly, and particularly to a heat pipe which has an outer pipe incorporating an inner pipe therein.

2. Related Art

Historically, the use of metallic heat sinks has been sufficient to provide the thermal management required for most electronic cooling applications. However, with a new breed of compact electronic devices requiring dissipation of larger heat loads, the efficacy of metallic heat sinks is sometimes limited due to the weight and physical size of the heat sink required to perform the cooling. Accordingly, the use of heat pipes is becoming an increasingly popular solution of choice.

Conventional heat pipes are sealed vacuum vessels that are partly filled with working fluid. When external heat is input at an evaporating end, the working fluid is vaporized, creating a pressure gradient in the heat pipe. This pressure gradient forces the vapor to flow along the heat pipe to a cooler section (a condensing end) where it condenses and releases latent heat that was absorbed in the process of the vaporization. The condensed working fluid then returns to the evaporating end through a wicking structure that provides capillary forces. There are several types of wicking structures in common use, including grooves, screening, fibers, and sintered metal powder. An example of a conventional wicking structure is disclosed in Taiwan Patent Application No. 86206429. A plurality of fibers is formed at an inner face of the heat pipe. At least one V-shaped groove is defined in each fiber along an axial direction of the fiber. Another example of a conventional wicking structure is disclosed in Taiwan Patent Application No. 88209813. A piece of metal screening is attached to an inner face of a heat pipe. The metal screening has a plurality of through holes, and a plurality of grooves defined in a surface thereof along an axial direction of the heat pipe. However, the capillary forces provided by these conventional wicking structures are often still not sufficient. Furthermore, the vapor and the condensed fluid flow in the same pipe in opposite directions and interfere with each other. This retards the heat dissipating efficiency of the heat pipe.

Thus a heat pipe that can overcome the above-described problems is desired.

BRIEF SUMMARY OF THE INVENTION

Accordingly, an object of the present invention is to provide a heat pipe which has good heat dissipating efficiency.

Another object of the present invention is to provide a heat pipe which incorporates an outer pipe and an inner pipe.

To achieve the above-mentioned objects, a heat pipe comprises an outer pipe, an inner pipe and a hermetic cap. The outer pipe has an evaporating end and a condensing end. The evaporating end is integrally sealed and receives working fluid. The cap seals the outer pipe at the condensing end. The inner pipe comprises an open top and an open bottom. A very narrow gap is defined between the inner pipe and the outer pipe. A plurality of granules is put into the gap to form a porous wicking structure. When the evaporating end is heated by an external heat source, the working fluid is vaporized and flows up along the inner pipe to the condensing end. The working fluid condenses at the condensing end, and flows back down to the evaporating end through the gap. Because the gap is very narrow, surface tension of the working fluid and capillary action of the outer and inner pipes is enhanced.

Other objects, advantages and novel features of the present invention will be drawn from the following detailed description of preferred embodiments of the present invention with the attached drawings, in which:

DESCRIPTION OF THE PREFERRED EMBODIMENTS

Figure 1:
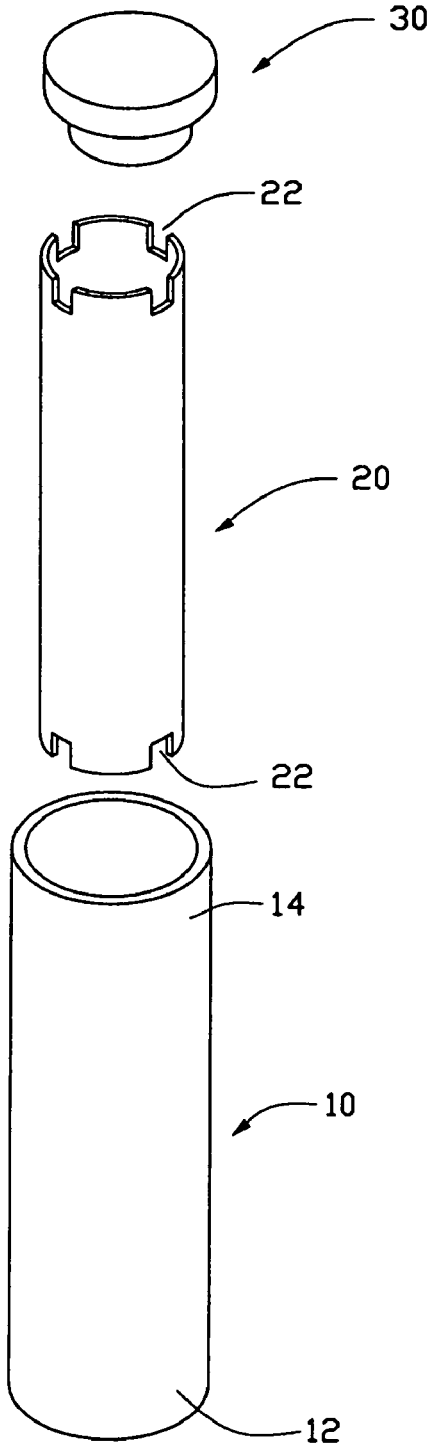
FIG. 1 is an exploded perspective view of a heat pipe in accordance with a preferred embodiment of the present invention, the heat pipe comprising an outer pipe, an inner pipe and a hermetic cap.

Referring to FIG. 1, a heat pipe in accordance with a preferred embodiment of the present invention comprises an outer pipe 10, an inner pipe 20 and a hermetic cap 30. The outer pipe 10 comprises an evaporating end 12, and an opposite condensing end 14. The evaporating end 12 comprises an integrally sealed bottom. The condensing end 14 comprises an open top to receive the hermetic cap 30. Working fluid (not shown) in liquid form is received in the evaporating end 12 of the outer pipe 10. The working fluid is adapted to readily evaporate. The inner pipe 20 comprises an open top and an open bottom. A plurality of evenly spaced cutouts 22 is defined in each of top and bottom ends of the inner pipe 20. The inner pipe 20 has a height approximately equal to a height of the outer pipe 10, and has an outer diameter slightly less than an inner diameter of the outer pipe 10.

Figure 2:
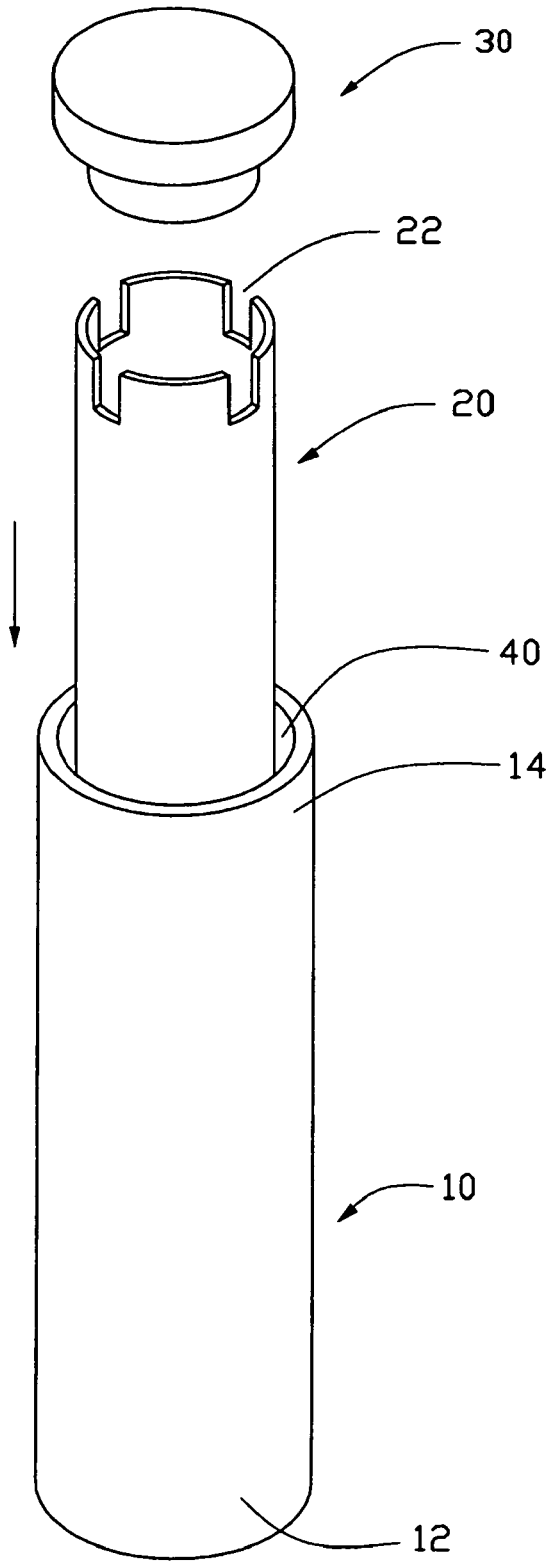
FIG. 2 is an enlarged view of FIG. 1, and showing the inner pipe being inserted into the outer pipe.
Figure 3:
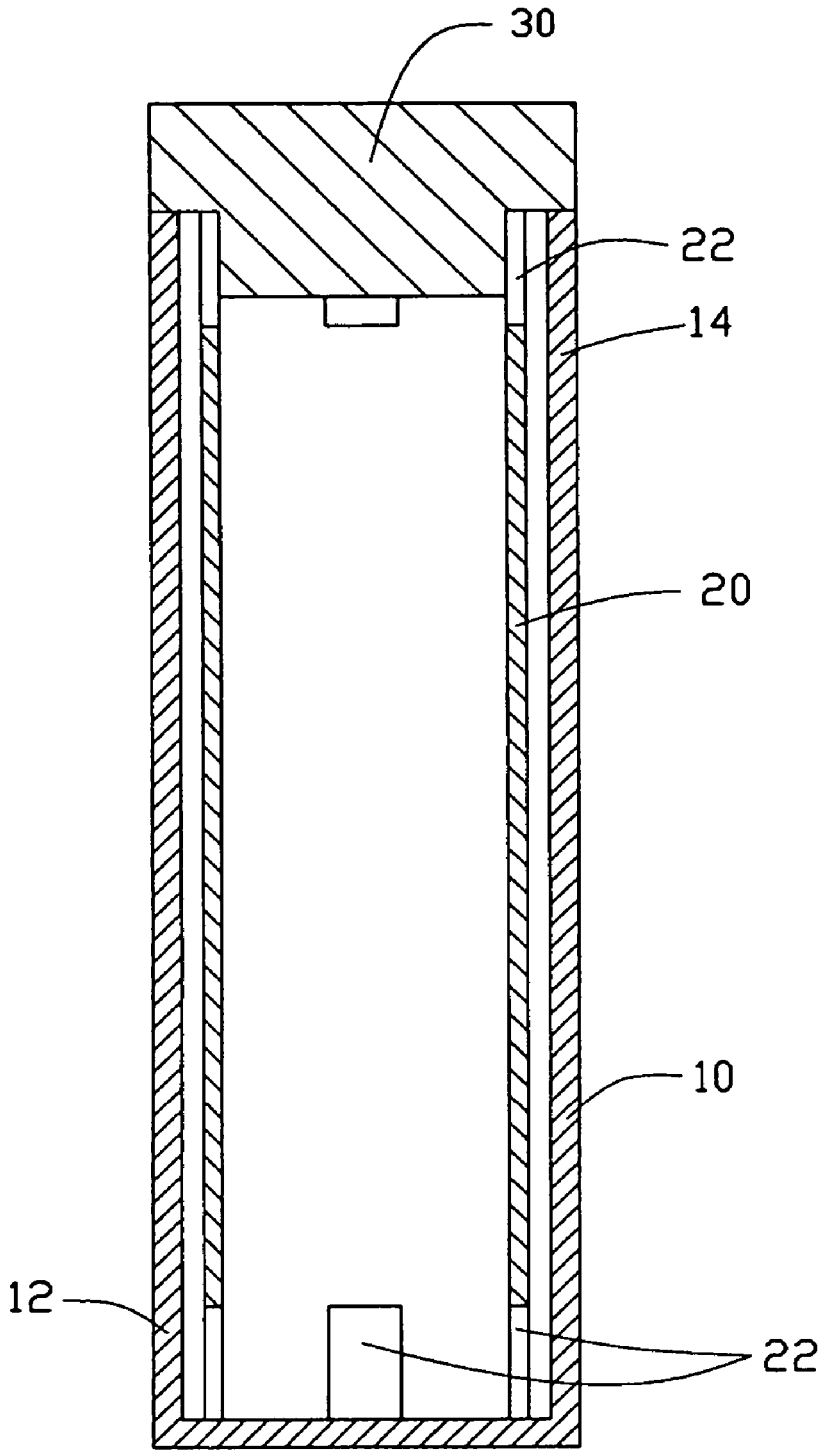
FIG. 3 is a cross-sectional view of the heat pipe of FIG. 1 fully assembled.

Referring also to FIGS. 2 and 3, in assembly, the inner pipe 20 is fixedly received in the outer pipe 10. A very narrow cylinder-shaped gap 40 is thereby defined between the outer pipe 10 and the inner pipe 20, to provide passage for condensed working fluid therebetween. Because the gap 40 is very narrow, surface tension of the working fluid and capillary action of the outer and inner pipes 10, 20 is enhanced. In addition, suitable granules can be put into the gap 40 to form a porous wicking structure, whereby capillary action is enhanced. The hermetic cap 30 is then plugged onto the condensing end 14 of the outer pipe 10, such that the cap 30 engages in the inner pipe 20. A hermetically sealed chamber is thereby formed within the outer pipe 10.

In operation, when the evaporating end 12 of the outer pipe 10 is heated by an external heat source (not shown), the working fluid is vaporized. The vapor flows upwardly inside the inner pipe 20 toward the condensing end 14 of the outer pipe 10 and away from the heat source, and condenses back to liquid working fluid at the condensing end 14. The condensed working fluid passes through the cutouts 22 at the condensing end 14 and enters the gap 40. The very narrow gap 40, whether having the described porous wicking structure or not, causes the condensed working fluid to rapidly flow back down to the evaporating end 12. At the evaporating end 12, the condensed working fluid enters the inner pipe 20 through the cutouts 22. As described above, the gap 40 provides passage for the condensed working fluid. Because the gap 40 is very narrow, it effectively prevents vapor from flowing upwardly therein. Thus the gap 40 circumvents the risk of upwardly flowing vapor interfering with downwardly flowing condensed working fluid.

Figure 4:
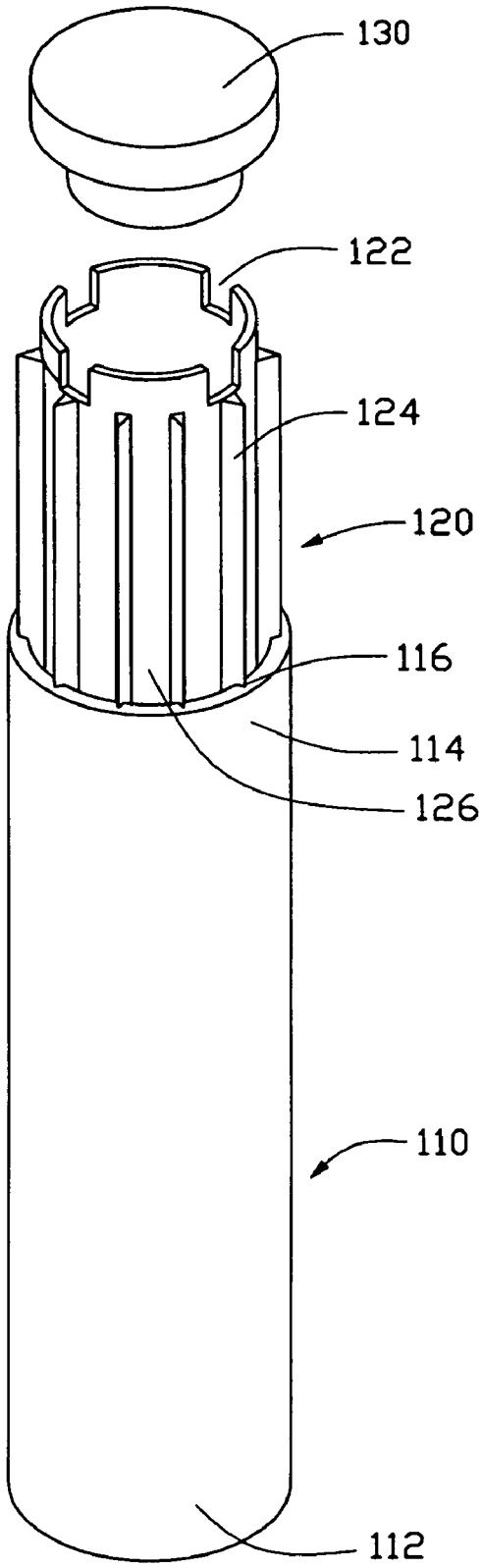
FIG. 4 is a partly assembled perspective view of a heat pipe in accordance with an alternative embodiment of the present invention.

FIG. 4 shows a heat pipe in accordance with an alternative embodiment of the present invention. The heat pipe comprises an outer pipe 110, an inner pipe 120, and a hermetic cap 130. The outer pipe 110 comprises an evaporating end 112, and an opposite condensing end 114. Working fluid (not shown) is received in the evaporating end 112 of the outer pipe 110. A plurality of evenly spaced and parallel longitudinal grooves 116 is defined in an inner surface of the outer pipe 110. The inner pipe 120 comprises an open top and an open bottom. A plurality of evenly spaced cutouts 122 is defined in each of top and bottom ends of the inner pipe 120. A plurality of evenly spaced and parallel longitudinal ribs 124 is formed on an outer surface of the inner pipe 120. Each rib 124 is partly received in a corresponding groove 116, and presses the outer pipe 110 to reinforce the heat pipe structure. Each two adjacent ribs 124 together with an outer surface of the inner pipe 120 and an inner surface of the outer pipe 110 cooperatively define a vertical capillary gap 126 therebetween, to enhance the capillary action of the heat pipe.

Figure 5:
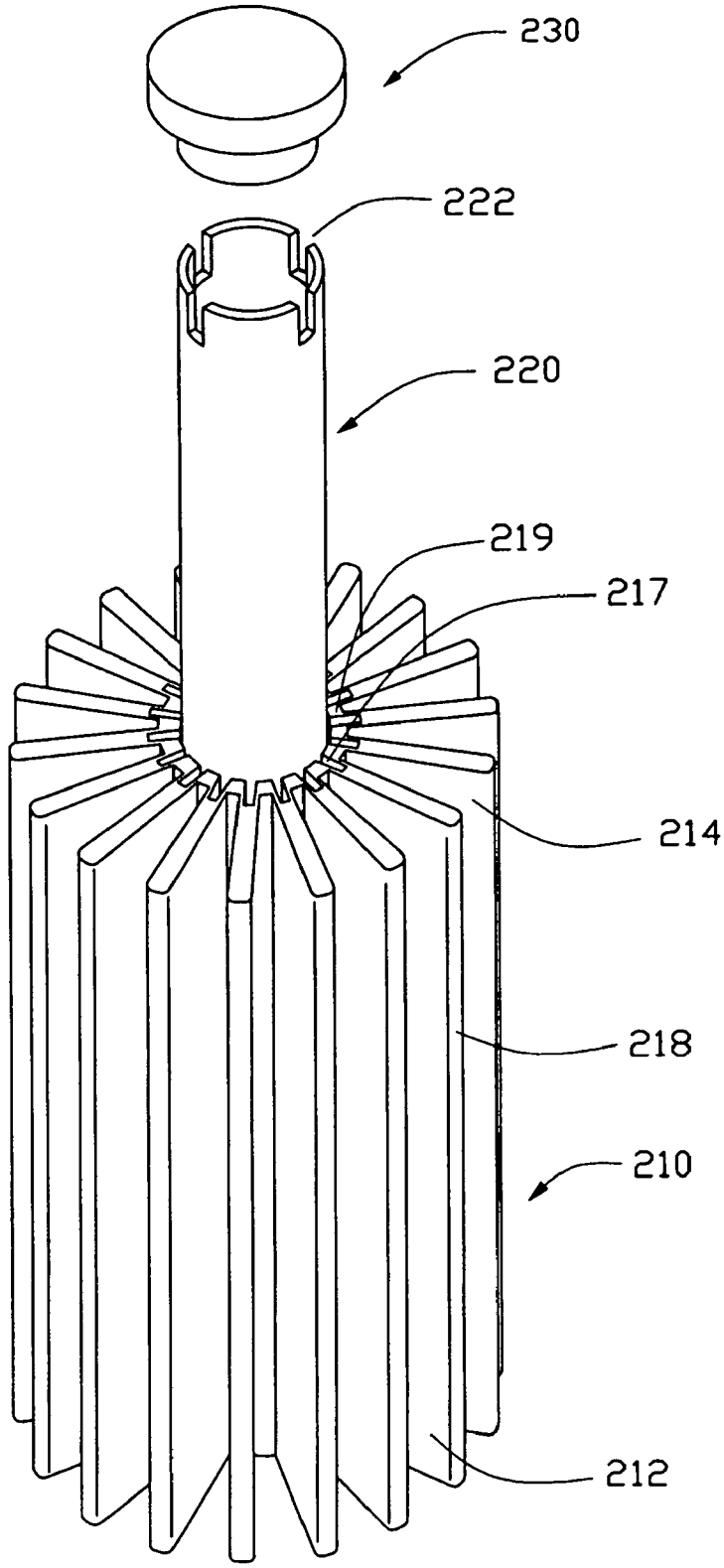
FIG. 5 is a partly assembled perspective view of a heat pipe in accordance with a further alternative embodiment of the present invention.

FIG. 5 shows a heat pipe in accordance with a further alternative embodiment of the present invention. The heat pipe comprises an outer pipe 210, an inner pipe 220, and a hermetic cap 230. The outer pipe has an evaporating end 212, and an opposite condensing end 214. Working fluid (not shown) is received in the evaporating end 212 of the outer pipe 210. The inner pipe 220 comprises an open top and an open bottom. A plurality of cutouts 222 is defined in each of top and bottom ends of the inner pipe 220. The outer pipe 210 comprises a plurality of evenly spaced and parallel longitudinal protrusions 219 at an inner periphery thereof. Each two adjacent protrusions 219 together with an inner surface of the outer pipe 210 and an outer surface of the inner pipe 220 cooperatively define a vertical capillary gap 217 therebetween, to enhance the capillary action of the heat pipe. The outer pipe 210 further comprises a plurality of evenly spaced and parallel longitudinal radiating fins 218 at an outer periphery thereof, for increasing a heat dissipating area of the heat pipe.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A heat pipe comprising:

an outer pipe receiving working fluid;

an inner pipe fixedly received in the outer pipe, at least one cutout being defined in each of opposite ends of the inner pipe for allowing the working fluid to pass between the inner pipe and the outer pipe; and a gap defined between the outer pipe and the inner pipe;

wherein the gap is very narrow such that an inner wall of the outer pipe and an outer wall of the inner pipe cooperatively form a wicking structure;

wherein a plurality of protrusions is arranged on the inner wall of the outer pipe, whereby a plurality of capillary gaps is defined between the outer pipe and the inner pipe;

wherein the inner pipe has a height approximately equal to a height of the outer pipe and wherein the working fluid passes between the inner pipe and the outer pipe only through the at least one cut defined in each of opposite ends of the inner pipe; and wherein the outer pipe has an integrally sealed bottom and an open top sealed by a cap.

2. The heat pipe of claim 1, wherein the cap is plugged onto the open top of outer pipe.

* * * * *